US008807992B2

(12) United States Patent
Wagner

(10) Patent No.: US 8,807,992 B2
(45) Date of Patent: Aug. 19, 2014

(54) FIRE GENERATOR HAVING A CONTROLLABLE VENTING MECHANISM

(76) Inventor: Jeffrey R. Wagner, Shortsville, NY (US)

( * ) Notice: Subject to any disclaimer, the term of this patent is extended or adjusted under 35 U.S.C. 154(b) by 924 days.

(21) Appl. No.: 12/757,269

(22) Filed: Apr. 9, 2010

(65) Prior Publication Data

US 2010/0266971 A1 Oct. 21, 2010

Related U.S. Application Data

(60) Provisional application No. 61/169,354, filed on Apr. 15, 2009.

(51) Int. Cl.
*F23Q 21/00* (2006.01)

(52) U.S. Cl.
USPC ..... 431/269; 431/253; 431/273; 206/85

(58) Field of Classification Search
CPC ..... F23Q 21/00; F23Q 7/14; F23Q 1/02; F23Q 1/00; F23Q 2/10; F23Q 2/14; F23Q 2/16
USPC ..... 431/253, 269, 273; 206/85
See application file for complete search history.

(56) References Cited

U.S. PATENT DOCUMENTS

| | | | | |
|---|---|---|---|---|
| 342,846 | A | 7/1895 | Diesel | |
| 608,845 | A | 8/1898 | Diesel | |
| 2,758,575 | A * | 8/1956 | Aloyse | 123/46 SC |
| 3,584,381 | A * | 6/1971 | Jamison | 30/228 |
| 4,154,434 | A * | 5/1979 | Wallis | 264/119 |
| 4,698,068 | A | 10/1987 | Jensen | |

* cited by examiner

*Primary Examiner* — Avinash Savani
(74) *Attorney, Agent, or Firm* — Michael J. Nickerson; Basch & Nickerson LLP

(57) ABSTRACT

A combustion device has a controllable venting mechanism, within a piston/plunger or a chamber/housing, to allow the flow of air out of the chamber to enable the piston/plunger to be freely inserted for the purpose of storage or to maintain the air within the chamber to enable the piston/plunger to create a pressure necessary for combustion.

25 Claims, 19 Drawing Sheets

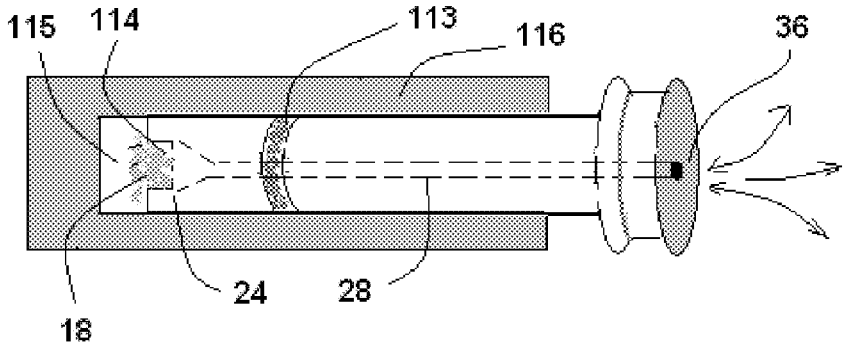
FIGURE 22
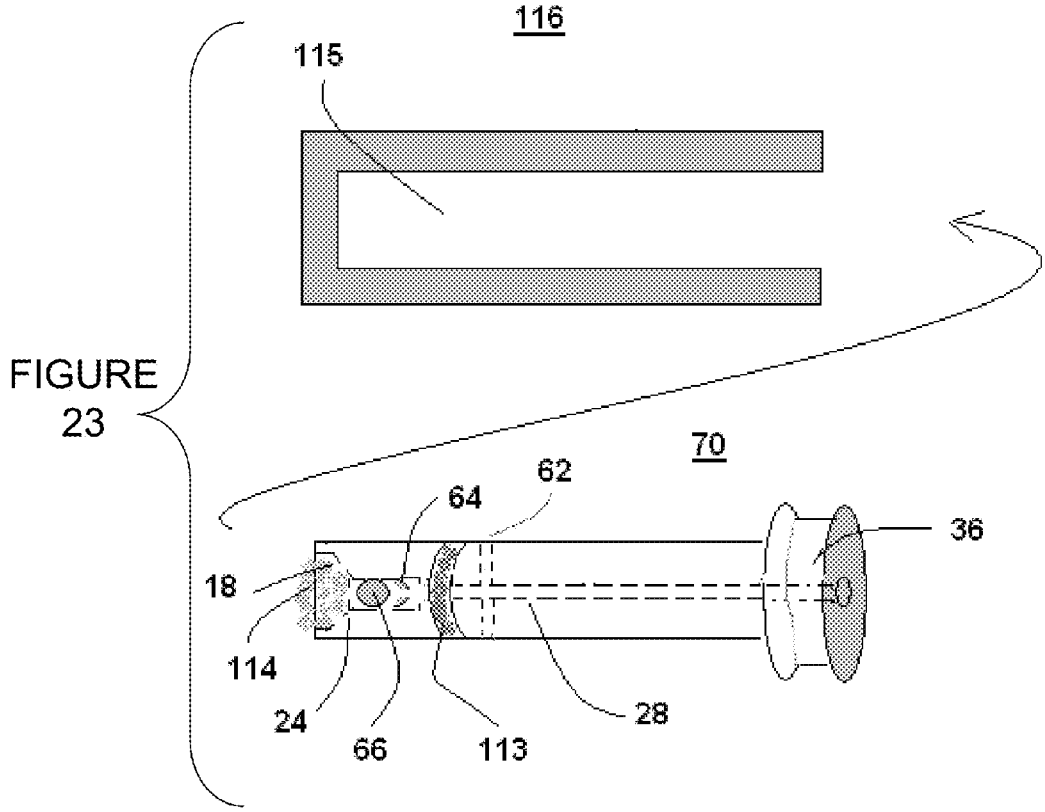

FIRE GENERATOR HAVING A CONTROLLABLE VENTING MECHANISM

PRIORITY INFORMATION

The present application claims priority, under 35 U.S.C. §119(e), from U.S. Provisional Patent Application Ser. No. 61/169,354, filed on Apr. 15, 2009. The entire content of U.S. Provisional Patent Application Ser. No. 61/169,354, filed on Apr. 15, 2009, is hereby incorporated by reference.

BACKGROUND

Conventionally, a manual device to create combustion of tinder utilizes high pressure to heat air to temperature of combustion with respect to the tinder. An example of a conventional combustion device is illustrated in FIG. 1.

As illustrated in FIG. 1, a conventional combustion device 1 includes a housing 16 (typically, a cylinder; however, other shapes can be used) having a chamber 15, an open end 161, and a closed end 162. A piston 12, having a handle 11, engages the housing 16.

The piston 12 also includes a pneumatic piston sealing device 13 (typically, an o-ring or wrapped string) that engages the side walls of the chamber 15 to prevent air from passing out of the chamber 15 as the piston 12 is pressed into the chamber 15. The piston 12 further includes tinder 14, which is to be combusted by the increased pressure in the chamber 15 caused by the piston 12 being pressed into the chamber 15.

It is noted that it is possible to achieve combustion, without a pneumatic piston sealing device, if tolerances are very small and the chamber/piston surfaces are smooth.

It is noted that the piston 12 may include a device to hold the tinder in place. It is further noted that the location of the pneumatic piston sealing device 13 on the piston is such that when the tinder 14 becomes located substantially next to the closed end 162, as illustrated in FIG. 2, the pressure within the chamber 15 is such that the tinder 14 combusts.

As illustrated in FIG. 2, to achieve combustion of the tinder 14, a force 17 is applied to the handle 11 to drive the piston 12 into the chamber 15 towards the closed end 162. Due to the pneumatic seal from the pneumatic piston sealing device 13, the pressure, within the chamber 15, increases such that tinder 14 eventually combusts. The piston 12 is then withdrawn to apply the combusted tinder 14 to kindling to start a fire.

After the tinder 14 has been combusted and applied to the kindling, it is desirable to store the piston 12 within the chamber 15 of housing 16. However, as illustrated if FIG. 3, a conventional combustion device 1 prevents the piston 12 from being stored within the chamber 15 of housing 16 because the pneumatic piston sealing device 13 prevents the release of air from the chamber 15. This causes the piston 12 to be partially stored within the chamber 15 of housing 16, as illustrated in FIG. 3.

As set forth above, the conventional combustion device can provide the ignition of tinder, however, the conventional combustion device hinders the piston 12 from being substantially stored within the chamber 15 of housing 16 because as previously discussed, operability requires a pneumatic seal, thereby preventing the assembling of the piston 12 and housing 16 together as a single unit, when not in use, and carried in a "closed" position (the piston 12 from being substantially stored within the chamber 15 of housing 16).

The partial storage of the piston 12 within the chamber 15 of housing 16 allows the piston 12 and the chamber 15 to be exposed to contamination and damage.

One conventional solution to this storage issue is to provide a special pouch, along with the conventional combustion device, to store the separate pieces within and to keep the piston 12 and the chamber 15 clean and free of damage. However, this conventional solution requires additional space and logistics for managing a pouch.

Another conventional solution to this storage issue, although counterproductive, is to breach the pneumatic seal formed by an o-ring with a string to encourage leakage when the piston is being placed within the chamber for storage. This requires the user to lift the o-ring from the piston and insert a string therebetween for storage and then remove the string from between the o-ring and piston when using the device for combustion. Thus, a user must continually disengage and re-engage the pneumatic seal from the piston, thereby weakening the seal increasing the failure rate for combustion.

A third conventional solution to this storage issue utilizes different size o-ring seals, whereby one has a cross sectional dimension to allow leakage of air and the other o-ring has a cross sectional dimension to enable combustion. In this solution, the o-ring having a cross sectional dimension to allow leakage of air is installed around the piston when the user desires to store the combustion device. This o-ring allows air to leak between the o-ring and side of the chamber so as to release the pressure therefrom. If the user desires combustion, the user must install the o-ring having a cross sectional dimension to enable combustion. This second o-ring pneumatically seals the chamber to enable combustion. In this third solution, a user must also continually disengage and re-engage the pneumatic seal from the piston, thereby weakening the seal increasing the failure rate for combustion.

Moreover, while the second and third solutions attempt to allow the piston to be fully inserted for storage, these solutions may also limit the maximum attainable pressure and thereby reduce the efficiency of the combustion device.

Therefore, it is desirable to provide a combustion device that facilitates storage of the piston and housing of a combustion device as a single unit.

BRIEF DESCRIPTION OF THE DRAWINGS

The drawings are only for purposes of illustrating various embodiments and are not to be construed as limiting, wherein:

FIG. 22 is an isometric view of a combustion device having the chamber cut-away showing it used as a forced air supply to the tinder cavity of the piston;

FIG. 23 is an assembly view of an alternative embodiment, whereby a ball check valve is open with low pressure and closed in the presence of high pressure;

DETAILED DESCRIPTION

Figure 1:
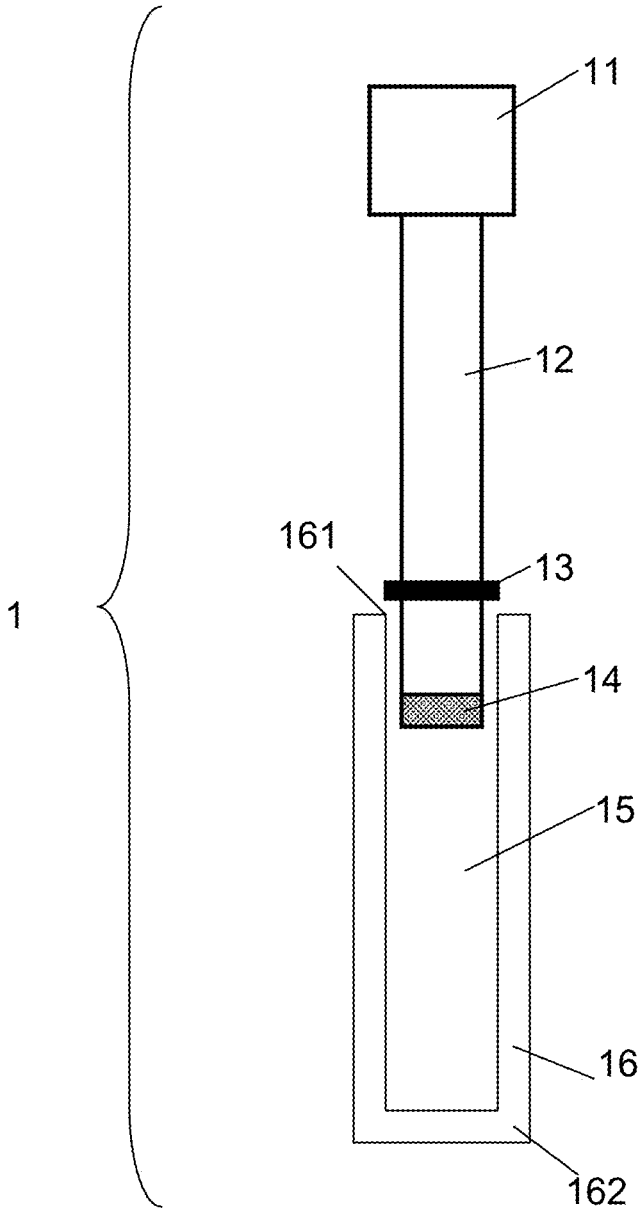
FIG. 1 illustrates a conventional combustion device in an open state.
Figure 2:
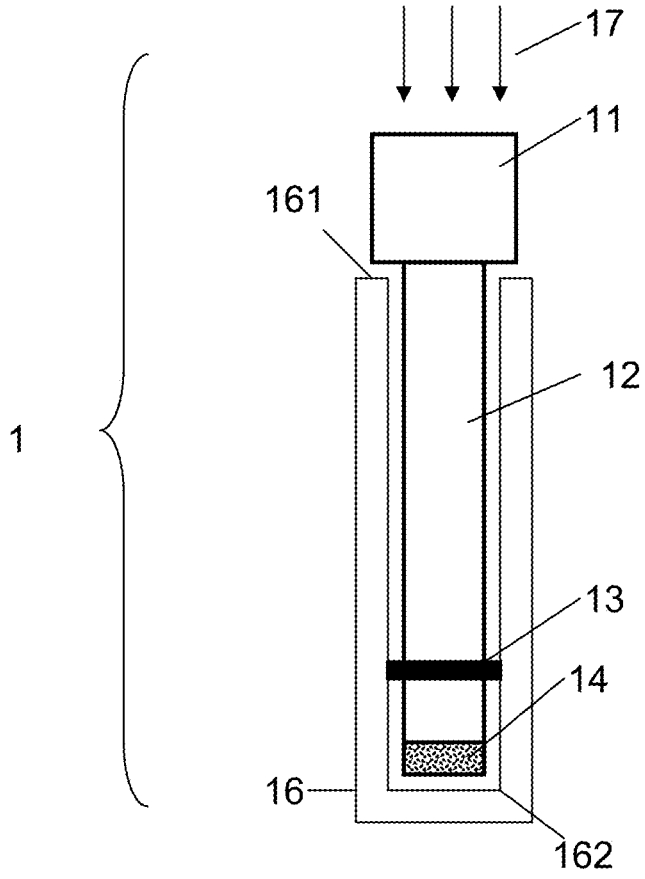
FIG. 2 illustrates a conventional combustion device in a closed or combustion state.
Figure 3:
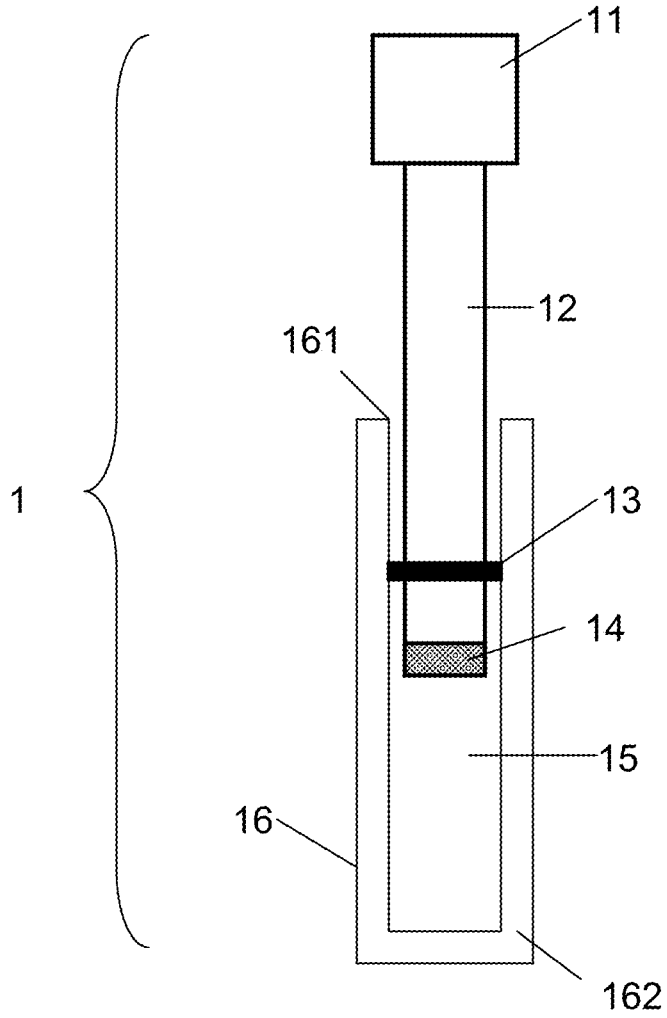
FIG. 3 illustrates a conventional combustion device in a partial storage state.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

In the various examples discussed below, a relief valve has been provided to allow a piston to be fully inserted within a chamber for storage.

Figure 4:
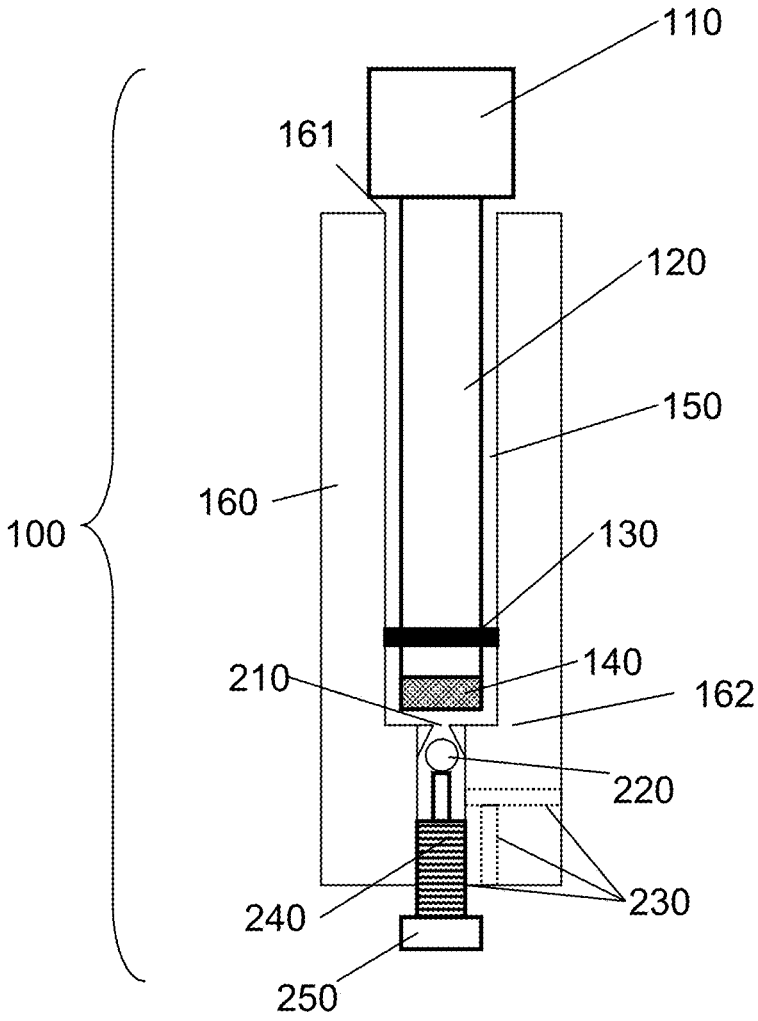
FIG. 4 illustrates an example of a combustion device with a pressure relief mechanism in a pressure relief state.

FIG. 4 illustrates an example of a combustion device with a pressure relief mechanism in a pressure relief state. As illustrated in FIG. 4, a combustion device 100 includes a housing 160 (typically, a cylinder; however, other shapes can be used) having a chamber 150, an open end 161, and a closed end 162. A piston 120, having a handle 110, engages the housing 160.

The piston 120 also includes a pneumatic piston sealing device 130 (typically, an o-ring or wrapped string) that engages the side walls of the chamber 150 to prevent air from passing out of the chamber 150 as the piston 120 is pressed into the chamber 150. The piston 120 further includes tinder 140 (located at a tinder positioning area, tinder cavity, or tinder end of the piston 120), which is to be combusted by the increased pressure in the chamber 150 caused by the piston 120 being pressed into the chamber 150.

It is noted that it is possible to achieve combustion, without a pneumatic piston sealing device, if tolerances are very small and the chamber/piston surfaces are smooth.

Figure 5:
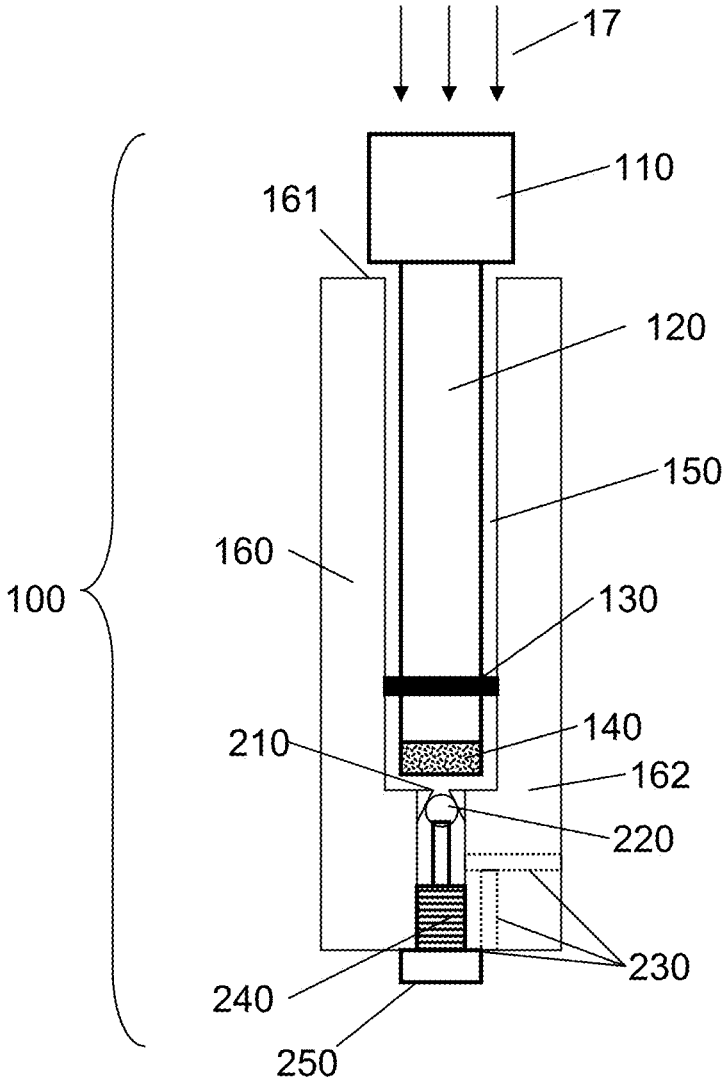
FIG. 5 illustrates the combustion device with pressure relief mechanism of FIG. 4 in a combustion state.

It is noted that the piston 120 may include a device to hold the tinder in place. It is further noted that the location of the pneumatic piston sealing device 130 on the piston is such that when the tinder 140 (located at a tinder positioning area, tinder cavity, or tinder end of the piston 120) becomes located substantially next to the closed end 162, as illustrated in FIG. 5, the pressure within the chamber 150 is such that the tinder 140 combusts.

As further illustrated in FIG. 4, combustion device 100 includes a pressure relief mechanism. The pressure relief mechanism includes an opening 210 in the chamber 150. The opening 210 is located between the location of the pneumatic piston sealing device 130 and the closed end 162 of the chamber 150 or at the closed end 162 of the chamber 150, as illustrated. The opening 210 enables the release of air from the chamber 150.

The pressure relief mechanism also includes a pneumatic sealing device 220, which enables the pneumatic sealing of the opening 210 when engaged therewith. The pneumatic sealing device 220 may be comprised of rubber or deformable material, which conforms to the opening 210 so as to provide a pneumatic seal. An engagement mechanism 240, having a handle 250, is used to engage or disengage the pneumatic sealing device 220 with the opening 210. The handle 250 enables the user to operate the engagement mechanism 240.

As illustrated in FIG. 4, the engagement mechanism 240 may be a member having threads that causes the member to traverse towards and away from the pneumatic sealing device 220. The threads also enable the engagement mechanism 240 to remain in a desired position.

The opening 210 is pneumatically connected to a relief channel 230, which allows the air within the chamber 150 to escape if the pneumatic sealing device 220 is not engaged with the opening 210, as illustrated in FIG. 4. The relief channel 230 may be located so as to allow the air to escape at various locations in the housing 160, as illustrated. It is further noted that the air may escape back through the engagement mechanism 240.

As illustrated in FIG. 4, when the engagement mechanism 240 is in a position which allows the pneumatic sealing device 220 to disengage from the opening 210, the air within the chamber 150 can readily escape, thereby allowing the piston 120 to be substantially placed within the chamber 150 without causing combustion. This allows the piston 120 to be stored substantially within the chamber 150.

To realize, combustion, as illustrated in FIG. 5, the engagement mechanism 240 is in a position, which allows the pneumatic sealing device 220 to be engaged with the opening 210. In this state, the air within the chamber 150 cannot readily escape, thereby allowing the piston 120 to increase the air pressure within the chamber 150, causing combustion of the tinder 140 (located at a tinder positioning area, tinder cavity, or tinder end of the piston 120).

As illustrated in FIGS. 4 and 5, the pressure relief mechanism enables combustion of the tinder 140 (located at a tinder positioning area, tinder cavity, or tinder end of the piston 120), as well as, relief of the pressure to enable appropriate storage of the piston 120 within the chamber 150.

Figure 6:
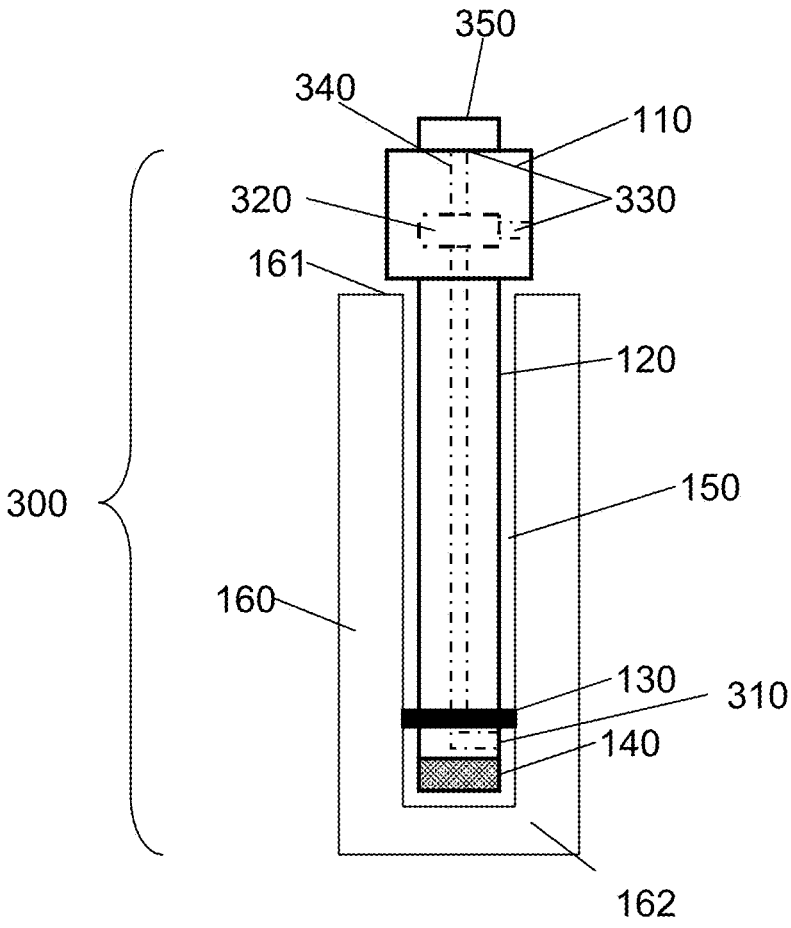
FIG. 6 illustrates another example of a combustion device with a pressure relief mechanism in a pressure relief state.

FIG. 6 illustrates a pressure relief mechanism located within the piston 120. The pressure relief mechanism includes an opening 310 in the piston 120. The opening 310 is located between the location of the pneumatic piston sealing device 130 and the tinder 140 (located at a tinder positioning area, tinder cavity, or tinder end of the piston 120), as illustrated. The opening 310 enables the release of air from the chamber 150.

The pressure relief mechanism also includes a pneumatic sealing device 320, which enables the pneumatic sealing of the opening 310 when engaged therewith. The pneumatic sealing device 320 may be comprised of rubber or deformable material, which provides a pneumatic seal. An engagement mechanism 340, having a handle 350, is used to engage or disengage the pneumatic sealing device 320. The handle 350 enables the user to operate the engagement mechanism 340.

The engagement mechanism 340 may be a member having threads that causes the member to traverse towards and away from the pneumatic sealing device. The threads also enable the engagement mechanism 340 to remain in a desired position.

The opening 310 is pneumatically connected to a relief channel 330, which allows the air within the chamber 150 to escape if the pneumatic sealing device 320 is not engaged. The relief channel 330 may be located so as to allow the air to escape at various locations in the handle 110, as illustrated. It is further noted that the air may escape back through the engagement mechanism 340.

When the engagement mechanism 340 is in a position which allows the pneumatic sealing device 320 to disengage, the air within the chamber 150 can readily escape, thereby allowing the piston 120 to be substantially placed within the chamber 150 without causing combustion. This allows the piston 120 to be stored substantially within the chamber 150.

To realize, combustion, the engagement mechanism 340 is in a position, which allows the pneumatic sealing device 320 to be engaged. In this state, the air within the chamber 150 cannot readily escape, thereby allowing the piston 120 to increase the air pressure within the chamber 150, causing combustion of the tinder 140 (located at a tinder positioning area, tinder cavity, or tinder end of the piston 120).

As illustrated in FIG. 6, the pressure relief mechanism enables combustion of the tinder 140 (located at a tinder positioning area, tinder cavity, or tinder end of the piston 120), as well as, relief of the pressure to enable appropriate storage of the piston 120 within the chamber 150.

Figure 7:
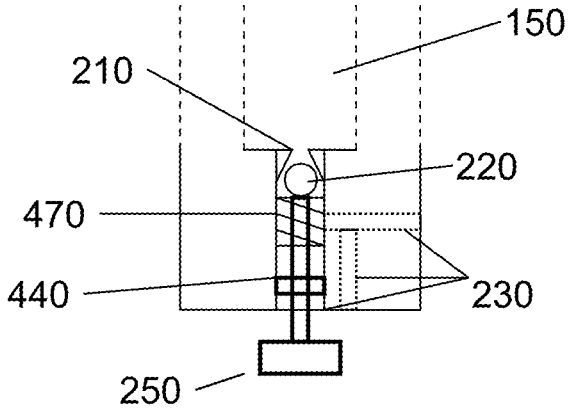
FIG. 7 illustrates an example of a pressure relief mechanism in a pressure relief state.

FIG. 7 illustrates another example of a pressure relief mechanism located within the housing. The pressure relief mechanism includes an opening 210 in the chamber 150. The opening 210 is located between the location of the pneumatic piston sealing device and the closed end of the chamber 150 or at the closed end of the chamber 150, as illustrated. The opening 210 enables the release of air from the chamber 150.

The pressure relief mechanism also includes a pneumatic sealing device 220, which enables the pneumatic sealing of the opening 310 when engaged therewith. The pneumatic sealing device 220 may be comprised of rubber or deformable material, which conforms to the opening 210 so as to provide a pneumatic seal.

An engagement mechanism, comprising a locking device 440, a bias spring 470, and a handle 250, is used to engage or disengage the pneumatic sealing device 220. The handle 350 enables the user to operate the locking device 440.

The bias spring 470 may be used to bias the engagement mechanism to disengage the pneumatic sealing device 220 from the opening 210 or to bias the engagement mechanism to engage the pneumatic sealing device 220 with the opening 210. As illustrated in FIG. 7, the bias spring 470 is used to bias the engagement mechanism to disengage the pneumatic sealing device 220 from the opening 210.

The opening 210 is pneumatically connected to a relief channel 230, which allows the air within the chamber 150 to escape if the pneumatic sealing device 220 is not engaged. The relief channel 230 may be located so as to allow the air to escape at various locations in the housing, as illustrated. It is further noted that the air may escape back through the engagement mechanism.

When the engagement mechanism is in a position, which allows the pneumatic sealing device 220 to be disengaged from the opening 210, the air within the chamber 150 can readily escape, thereby allowing the piston to be substantially placed within the chamber 150 without causing combustion. This allows the piston to be stored substantially within the chamber 150.

Figure 8:
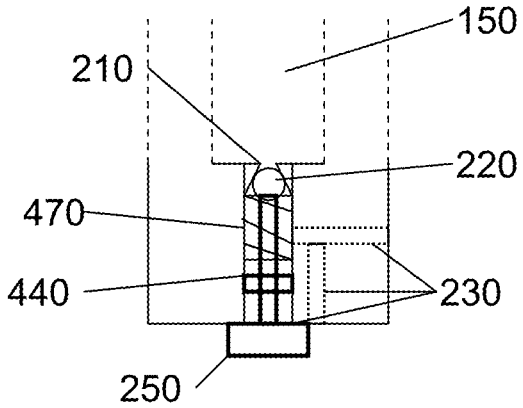
FIG. 8 illustrates the pressure relief mechanism of FIG. 7 in a combustion state.

To realize, combustion, the engagement mechanism is in a position, as illustrated in FIG. 8, which allows the pneumatic sealing device 220 to be engaged with the opening 210. In this state, the air within the chamber 150 cannot readily escape, thereby allowing the piston to increase the air pressure within the chamber 150, causing combustion of the tinder 140 (located at a tinder positioning area, tinder cavity, or tinder end of the piston 120).

As illustrated in FIGS. 7 and 8, the pressure relief mechanism enables combustion of the tinder, as well as, relief of the pressure to enable appropriate storage of the piston within the chamber 150.

FIGS. 9-12 illustrate an example of the locking device 440, which provides the engagement or disengagement of the pneumatic sealing device 220.

Figure 9:
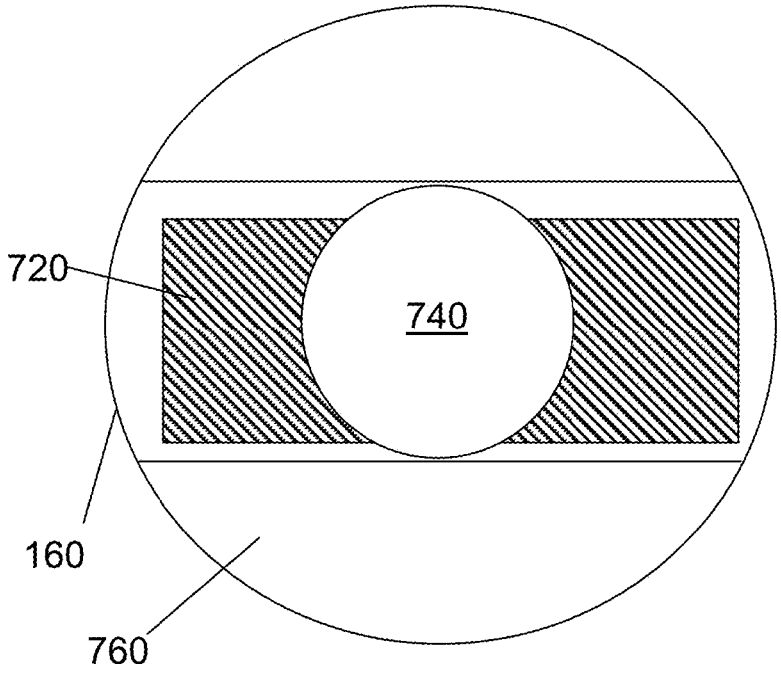
FIG. 9 illustrates a top view of an example of another pressure relief mechanism in an unlocked state.

As illustrated in FIG. 9, the locking mechanism includes a projecting member 720, which is part of a driving member 740. The driving member 740 traverses the pressure relief mechanism so as to cause the pneumatic sealing device 220 to be engaged with the opening 210 or the pneumatic sealing device 220 to be disengaged from the opening 210. As further illustrated in FIG. 9, the projecting member 720 should be positioned to pass through an opening formed by shelf members 760 that project from the housing 160 within the pressure relief mechanism to enable the driving member to traverse the pressure relief mechanism in such a manner to enable the pneumatic sealing device 220 to be engaged with the opening 210.

Figure 10:
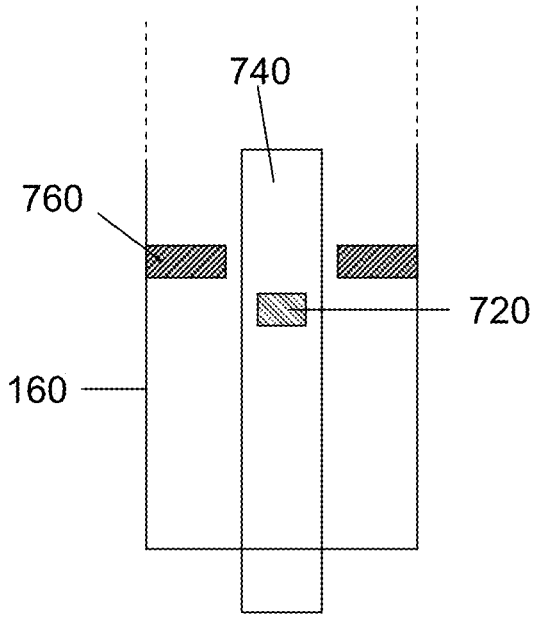
FIG. 10 illustrates a side view of the example of the pressure relief mechanism of FIG. 9 in an unlocked state.

FIG. 10 illustrates the relationship between the projecting member 720 and the shelf members 760 to enable the projecting member 720 to pass the shelf members 760 so that the pneumatic sealing device 220 can be engaged with the opening 210.

Figure 11:
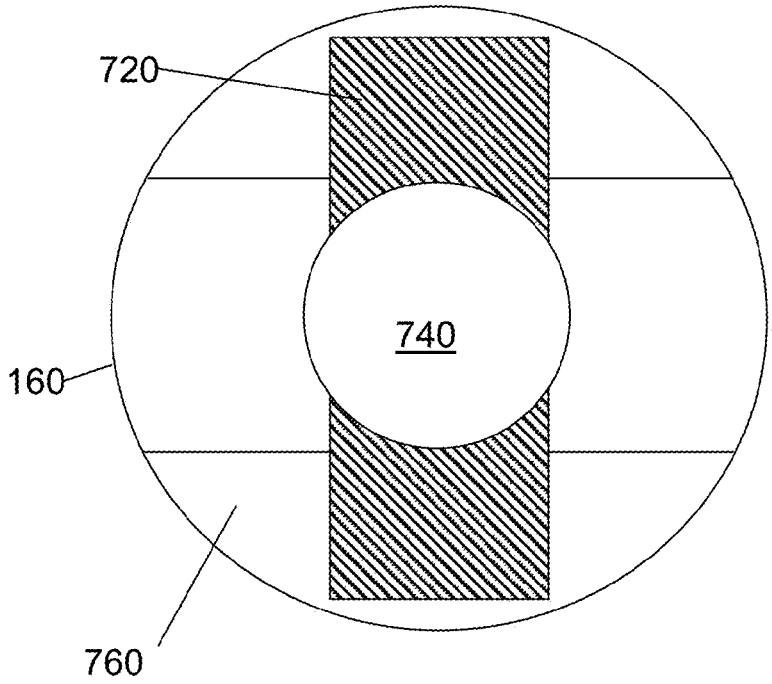
FIG. 11 illustrates a top view of the another pressure relief mechanism of FIG. 9 in a locked state.

FIG. 11 illustrates the top view of the relationship between the projecting member 720 and the shelf members 760 to enable the projecting member 720 to engage the shelf members 760 so that the pneumatic sealing device 220 is kept engaged with the opening 210.

Figure 12:
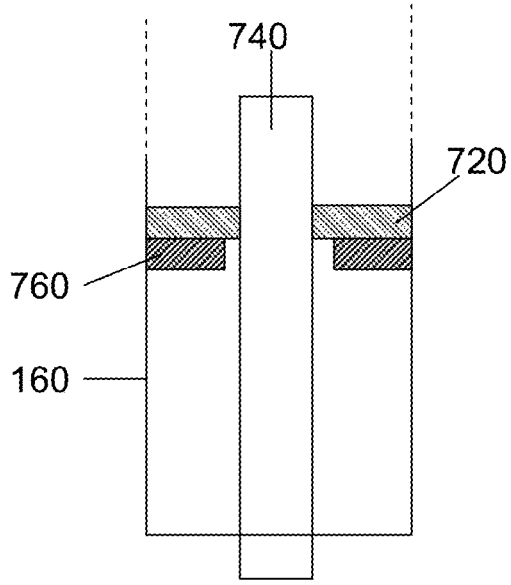
FIG. 12 illustrates a side view of the example of the pressure relief mechanism of FIG. 11 in a locked state.

FIG. 12 illustrates the side view of the relationship between the projecting member 720 and the shelf members 760 to enable the projecting member 720 to engage the shelf members 760 so that the pneumatic sealing device 220 is kept engaged with the opening 210.

As described above, by integrating a valve into either the chamber/housing or piston, the pressure can be readily relieved on demand by simply venting the chamber through a manually activated valve.

Figure 13:
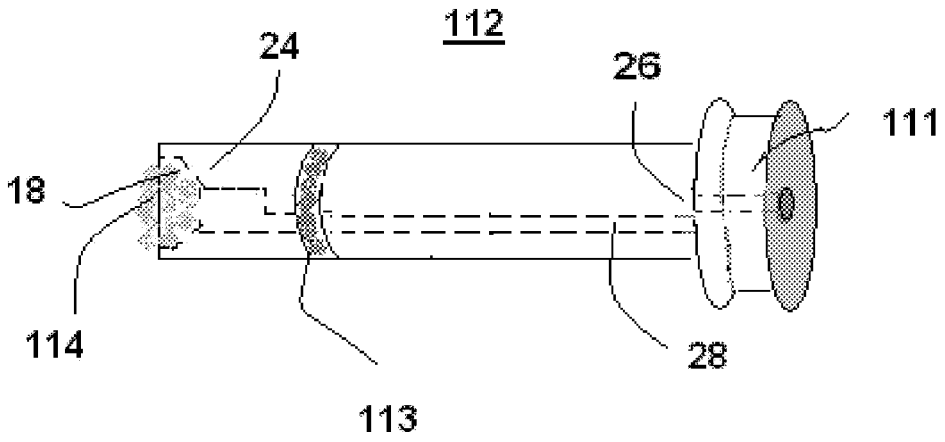
FIG. 13 is an isometric view of a piston having a rotary valve in the handle.
Figure 14:
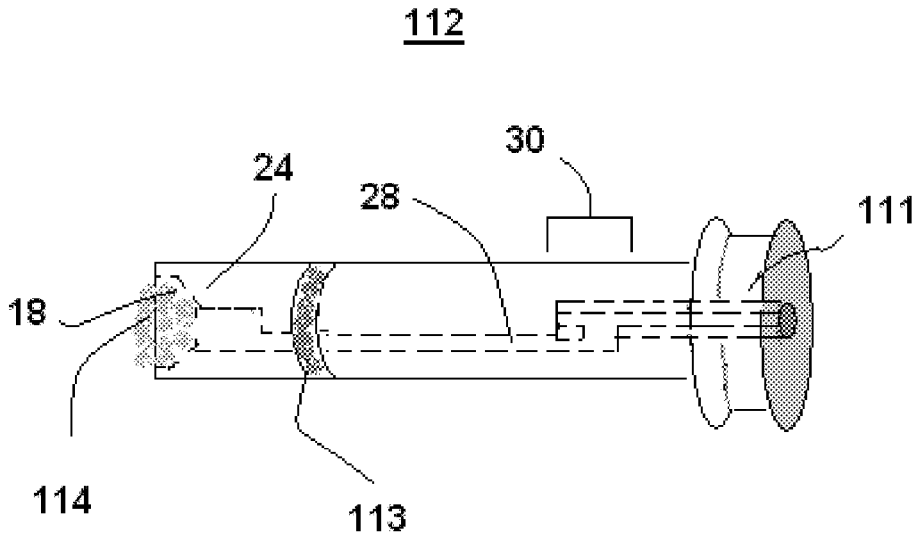
FIG. 14 is the same piston view as FIG. 13 wherein the rotary valve is within a tube attached to the handle.

With respect to FIGS. 13 and 14, a rotary valve configuration is shown incorporated within the proximal region of piston 112. Air channel 28 passes completely through piston 112, including handle 111 and is offset from the centerline by a distance greater than the diameter of air channel 28.

Rotary valve 26, as illustrated in FIG. 13, includes handle 111 axially mounted to piston 112 so as to rotate about the centerline. Accordingly, when air channel 28 comes into alignment with the air channel in handle 111, chamber 12 is vented to the atmosphere, allowing piston 112 to freely move into the chamber without combustion.

In FIG. 14, a similar rotary valve is depicted; however the proximal end of air channel 28 comprises air manifold 30 having handle 111 centrally attached thereto. Air manifold 30 is rotated by handle 111 and vents cylinder 116 as a slot in manifold 30 aligns with a corresponding slot in air channel 28, and as before chamber 115 is vented to the atmosphere, thereby allowing piston 112 to pass into the chamber without combustion.

Figure 15:
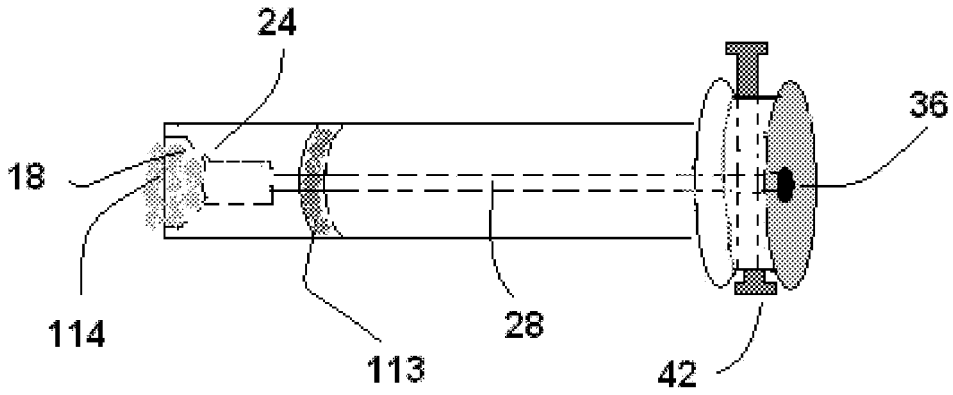
FIG. 15 is an isometric view of a piston having a linear slide valve within the handle.
Figure 16:
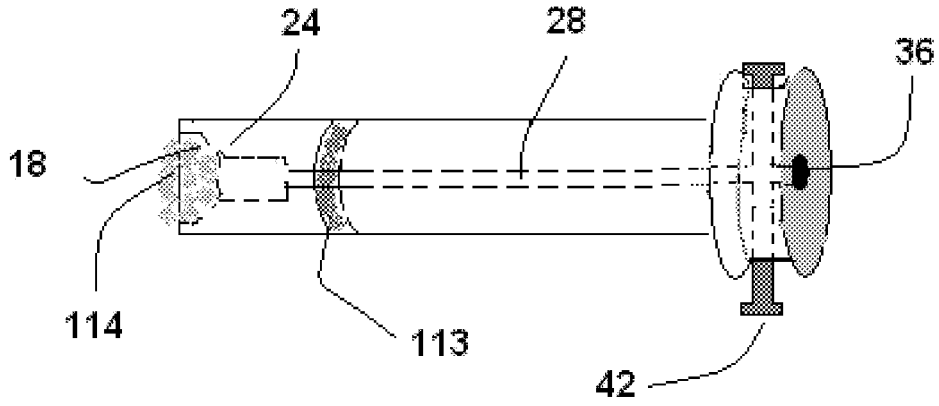
FIG. 16 is the same piston view of FIG. 15 wherein the slide valve is open.

In FIGS. 15 and 16, a linear slide valve 42 is caused to toggle between open and closed by pressing on the movable slider. In order to vent chamber 115, an opening in slider 42 is aligned with the proximal open end of air channel 28, thereby passing air from chamber 115 up through piston 112 and piston air vent 36 in handle 111. When combustion device 100 is in use to ignite tinder 20, slide valve 42 is placed in a position to cap off air channel 28 from piston air vent 36.

Figure 17:
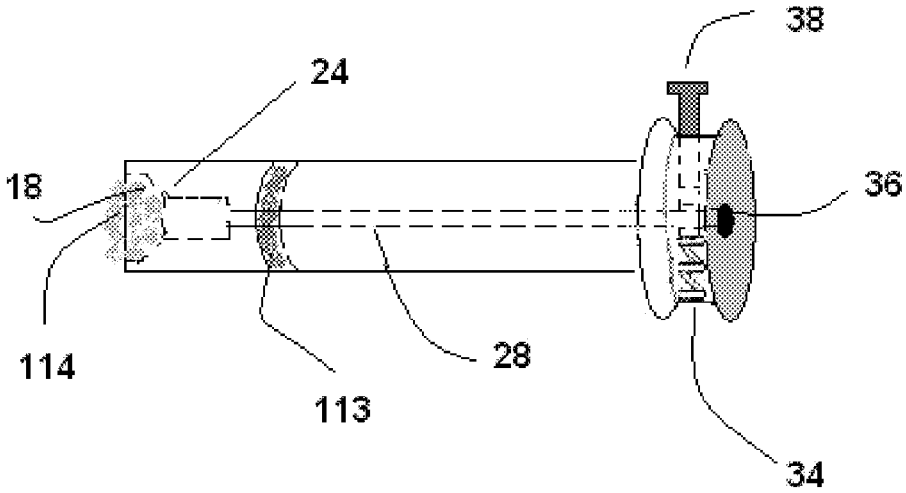
FIG. 17 is the same piston view of FIG. 15 wherein the slide valve is spring biased in the normally open or the normally closed position within the handle.

In FIG. 17, the slide valve provides for either a normally open or normally closed native mode position by utilizing spring 34. Spring 34 maintains actuator 38 in either an open position (air channel 28 aligned to piston air vent 36) or closed (end of air channel 28 sealed off from air vent 36). In the normally open mode, actuator 38 must be held down to enable pressure to be developed in chamber 12 and conversely is released to relieve pressure and allow the piston to be fully inserted for storage. The normally closed configuration, that is, spring 34 maintains actuator 38 across air channel 28, allows pressure to build up in chamber 12 without having to actuate the valve.

The venting of chamber 115 through piston 112 allows air entering air channel 28 to be predisposed to first pass through tinder cavity 18 to be subsequently expelled at piston air vent 36 via air channel 28 when the rotary valve 26, or slide valve 42, are in an opened position. Screen 24 forms the bottom surface of tinder cavity 18 and provides a grate to prohibit any tinder from entering channel 28. This configuration allows air to pass directly through tinder 20, which is initially only a smoldering ember. The increased availability of oxygen readily promotes combustion, which leads to glowing embers that ultimately encourages fire starting by consequently igniting the kindling.

Figure 18:
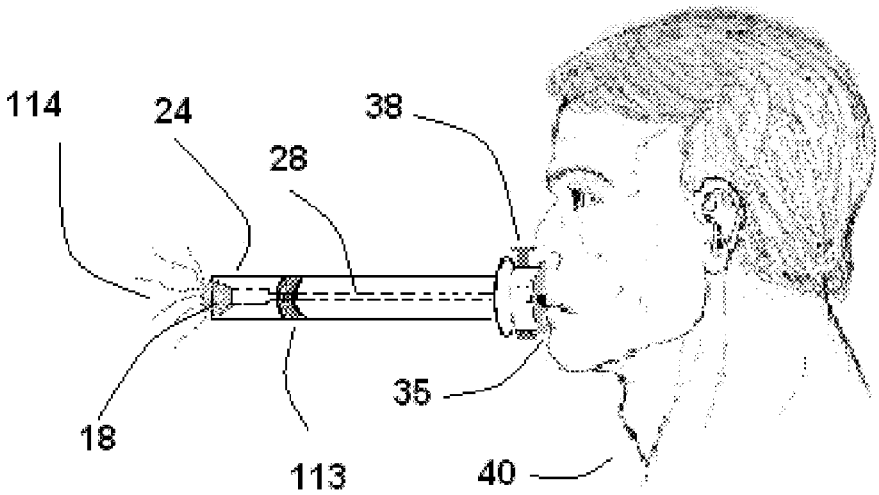
FIG. 18 is a view of a person blowing directly into the piston so as to cause air to pass through the smoldering tinder.

As illustrated in FIG. 18, once combustion has occurred, air can be forced across tinder 20 by blowing into piston air vent 35. Additionally, when it is time to bring tinder 20 in contact with the kindling, a sharp burst of air blown into air vent 36, can propel the burning tinder into the fire pit.

FIG. 22 illustrates another example of moving air over the tinder, whereby the piston is freely moved in and out, with a valve in the open position, to bi-directionally pump air directly through the tinder for the purpose of intensifying the available oxygen. However, this method requires a certain level of skill in monitoring the smoke coming from air vent 36 do to the fact that excessive amounts of forced air will tend to cool the tinder below its combustion point.

Figure 19:
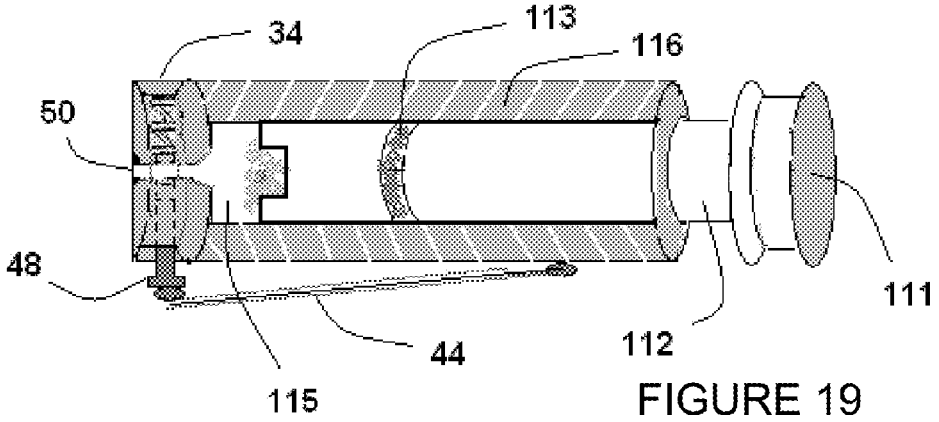
FIG. 19 is an isometric cut-away view of the chamber having a spring biased valve integrated within the chamber head and is either normally open or closed.
Figure 20:
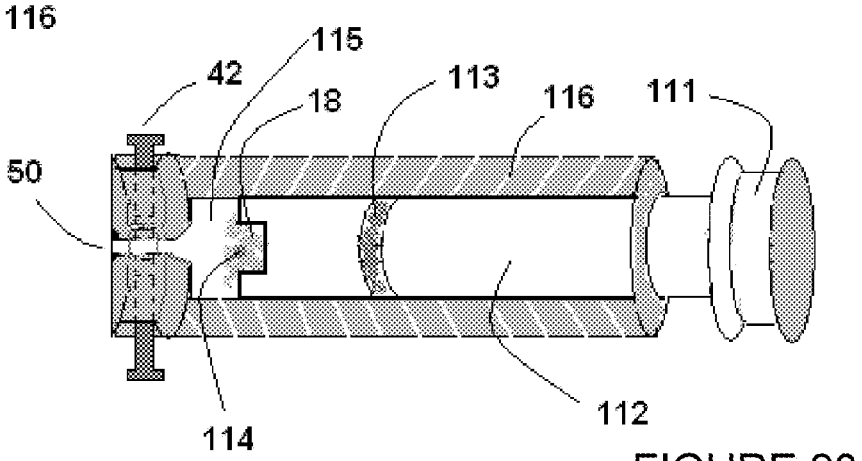
FIG. 20 is the same view as in FIG. 19 wherein a linear slide valve vents the chamber.

FIGS. 19-20 illustrate yet another example to evacuate chamber 115 by locating a valve controlled vent within the housing. As seen in FIGS. 19 and 20, the spring loaded valve of FIG. 17 is incorporated within the housing and will allow air pressure to be purged in a similar manner. Optionally, valve lever 44 may be included as an ergonomic feature to allow the valve to be actuated while gripping fire pistol 10 in one hand.

As previously noted, slide valve 42 may be positioned as normally open or normally closed, based on user preference, however a normally closed position provides a vacuum to keep the piston engaged once inserted into the storage position and thereby eliminating the need for a latch.

Figure 21:
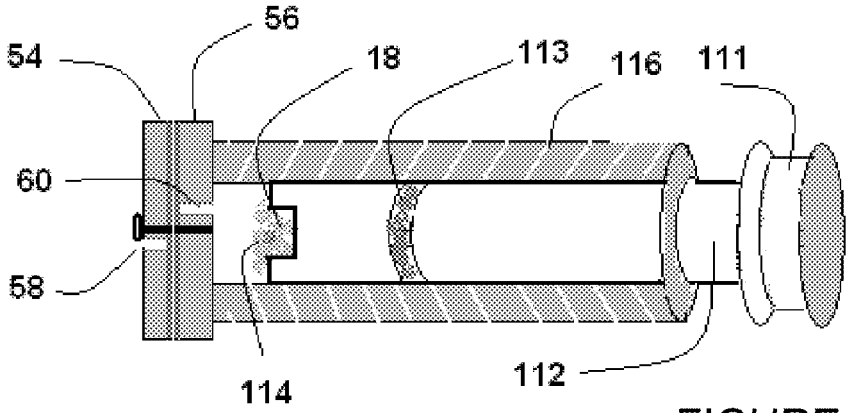
FIG. 21 is the same view as in FIG. 19 wherein the vent is controlled by a rotary valve within the housing.

FIG. 21 is another example of a pressure relief mechanism, whereby a rotary valve serves to vent chamber 12 to the atmosphere when rotor aperture 58 is in direct angular alignment with stator aperture 60. Stator 56, having an off-center aperture 60 within, forms the closed end of chamber 115, whereby a fulcrum pin therein provides an axis for rotor 54 about which to revolve. Furthermore, rotor 54 provides an airtight seal along the exposed distal surface of stator 56 and is indexed so as the radial position the offset rotor aperture 58 is indicated relative to stator aperture 60.

FIG. 23 serves to illustrate the use of a piston integrated ball check valve whereby the ball is positioned by air pressure. In the case where piston 16 is to be inserted into the storage position, ball 66 is not full sealed against ball seat 64 due to a minimal air pressure force on the ball. However, when the piston is rapidly forced into chamber 115 for pressure combustion, ball 66 forms an air tight seal with seat 64. Air channel 28 is either vented through airway 62 into chamber 115, just above gasket 14 or in the alternative through piston vent 36.

Figure 24:
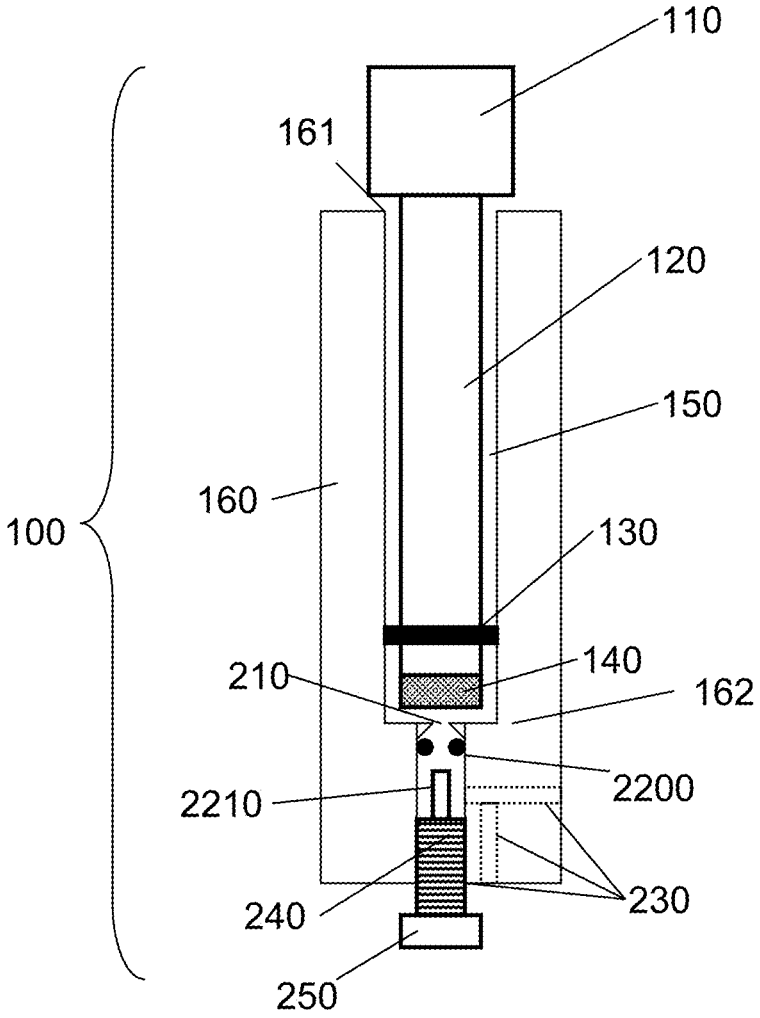
FIG. 24 illustrates an example of another combustion device with a pressure relief mechanism in a pressure relief state.

FIG. 24 illustrates another example of a combustion device with a pressure relief mechanism in a pressure relief state. As illustrated in FIG. 24, a combustion device 100 includes a housing 160 (typically, a cylinder; however, other shapes can be used) having a chamber 150, an open end 161, and a closed end 162. A piston 120, having a handle 110, engages the housing 160.

The piston 120 also includes a pneumatic piston sealing device 130 (typically, an o-ring or wrapped string) that engages the side walls of the chamber 150 to prevent air from passing out of the chamber 150 as the piston 120 is pressed into the chamber 150. The piston 120 further includes tinder 140 (located at a tinder positioning area, tinder cavity, or tinder end of the piston 120), which is to be combusted by the increased pressure in the chamber 150 caused by the piston 120 being pressed into the chamber 150.

It is noted that it is possible to achieve combustion, without a pneumatic piston sealing device, if tolerances are very small and the chamber/piston surfaces are smooth.

Figure 25:
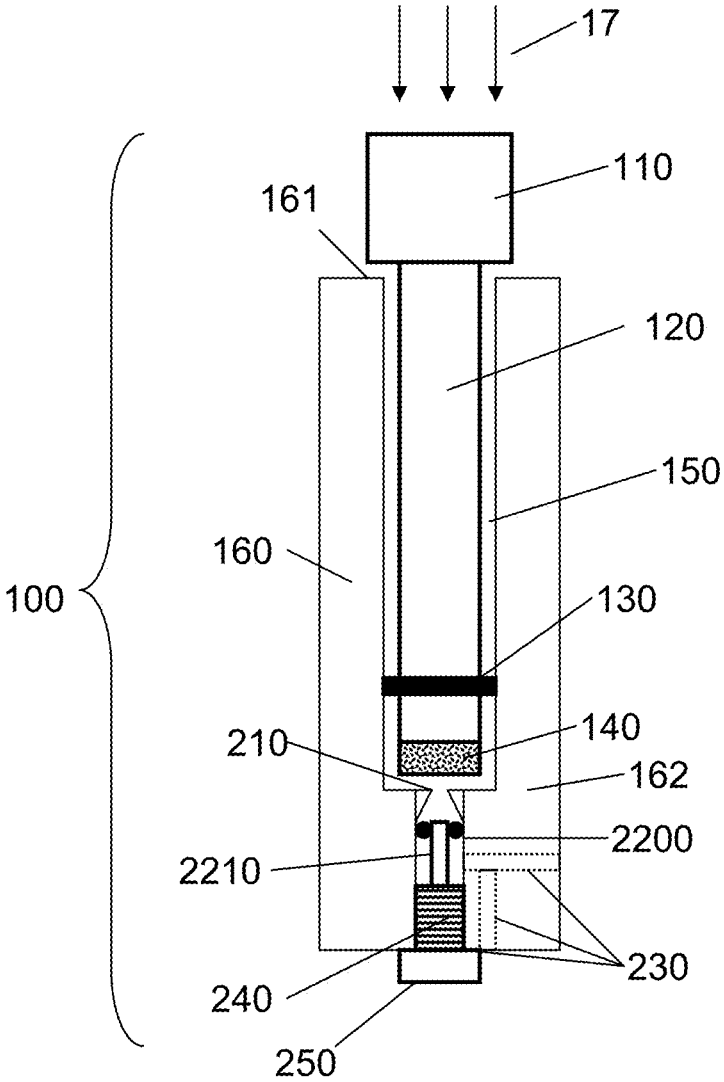
FIG. 25 illustrates the combustion device with pressure relief mechanism of FIG. 24 in a combustion state.

It is noted that the piston 120 may include a device to hold the tinder in place. It is further noted that the location of the pneumatic piston sealing device 130 on the piston is such that when the tinder 140 (located at a tinder positioning area, tinder cavity, or tinder end of the piston 120) becomes located substantially next to the closed end 162, as illustrated in FIG. 25, the pressure within the chamber 150 is such that the tinder 140 combusts.

As further illustrated in FIG. 24, combustion device 100 includes a pressure relief mechanism. The pressure relief mechanism includes an opening 210 in the chamber 150. The opening 210 is located between the location of the pneumatic piston sealing device 130 and the closed end 162 of the chamber 150 or at the closed end 162 of the chamber 150, as illustrated. The opening 210 enables the release of air from the chamber 150.

The pressure relief mechanism also includes a pneumatic sealing device 2200. The pneumatic sealing device 2200 may be comprised of an o-ring, which engages with the side walls of the pressure relief channel and the plugging device 2210 of engagement mechanism 240 to provide a proper pneumatic seal.

It is noted that the combination of the o-ring sealing device 2200 and engagement mechanism 240 provide a mechanism against accidental loss of the pneumatic sealing device.

The engagement mechanism 240, having a handle 250, is used to engage or disengage the pneumatic sealing device 220 with the plugging device 2210. The handle 250 enables the user to operate the engagement mechanism 240.

As illustrated in FIG. 24, the engagement mechanism 240 may be a member having threads that causes the member to traverse towards and away from the pneumatic sealing device 2200. The threads also enable the engagement mechanism 240 to remain in a desired position.

The opening 210 is pneumatically connected to a relief channel 230, which allows the air within the chamber 150 to escape if the pneumatic sealing device 2200 is not engaged with the plugging device 2210, as illustrated in FIG. 24.

The relief channel 230 may be located so as to allow the air to escape at various locations in the housing 160, as illustrated. It is further noted that the air may escape back through the engagement mechanism 240.

As illustrated in FIG. 24, when the engagement mechanism 240 is in a position which allows the pneumatic sealing device 220 to disengage from the plugging device 2210, the air within the chamber 150 can readily escape, thereby allowing the piston 120 to be substantially placed within the chamber 150 without causing combustion. This allows the piston 120 to be stored substantially within the chamber 150.

To realize, combustion, as illustrated in FIG. 25, the engagement mechanism 240 is in a position, which allows the pneumatic sealing device 2200 to be engaged with the plugging device 2210. In this state, the air within the chamber 150 cannot readily escape, thereby allowing the piston 120 to increase the air pressure within the chamber 150, causing combustion of the tinder 140 (located at a tinder positioning area, tinder cavity, or tinder end of the piston 120).

As illustrated in FIGS. 24 and 25, the pressure relief mechanism enables combustion of the tinder 140 (located at a tinder positioning area, tinder cavity, or tinder end of the piston 120), as well as, relief of the pressure to enable appropriate storage of the piston 120 within the chamber 150.

Figure 26:
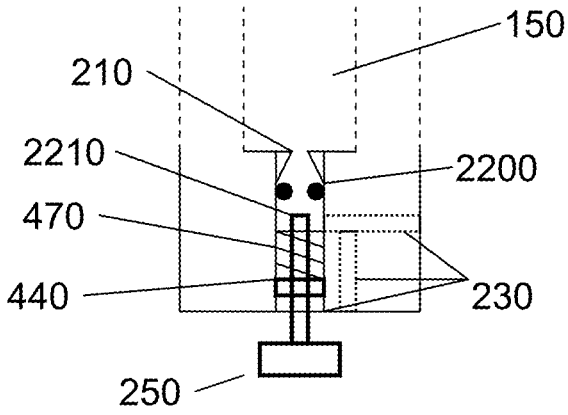
FIG. 26 illustrates an example of a pressure relief mechanism in a pressure relief state.

FIG. 26 illustrates another example of a pressure relief mechanism located within the housing. The pressure relief mechanism includes an opening 210 in the chamber 150. The opening 210 is located between the location of the pneumatic piston sealing device and the closed end of the chamber 150 or at the closed end of the chamber 150, as illustrated. The opening 210 enables the release of air from the chamber 150.

The pressure relief mechanism also includes a pneumatic sealing device 2200. The pneumatic sealing device 2200 may be comprised of an o-ring, which engages with the side walls of the pressure relief channel and the plugging device 2210 of engagement mechanism to provide a proper pneumatic seal.

An engagement mechanism, comprising a locking device 440, a bias spring 470, and a handle 250, is used to engage or disengage the pneumatic sealing device 2200 with the plugging device 2210. The handle 350 enables the user to operate the locking device 440.

The bias spring 470 may be used to bias the engagement mechanism to disengage the pneumatic sealing device 2200 from the plugging device 2210 or to bias the engagement mechanism to engage the pneumatic sealing device 2200 with the plugging device 2210. As illustrated in FIG. 26, the bias spring 470 is used to bias the engagement mechanism to disengage the pneumatic sealing device 2200 from the plugging device 2210.

The opening 210 is pneumatically connected to a relief channel 230, which allows the air within the chamber 150 to escape if the pneumatic sealing device 2200 is not engaged. The relief channel 230 may be located so as to allow the air to escape at various locations in the housing, as illustrated. It is further noted that the air may escape back through the engagement mechanism.

When the engagement mechanism is in a position, which allows the pneumatic sealing device 2200 to be disengaged from the plugging device 2210, the air within the chamber 150 can readily escape, thereby allowing the piston to be substantially placed within the chamber 150 without causing combustion. This allows the piston to be stored substantially within the chamber 150.

Figure 27:
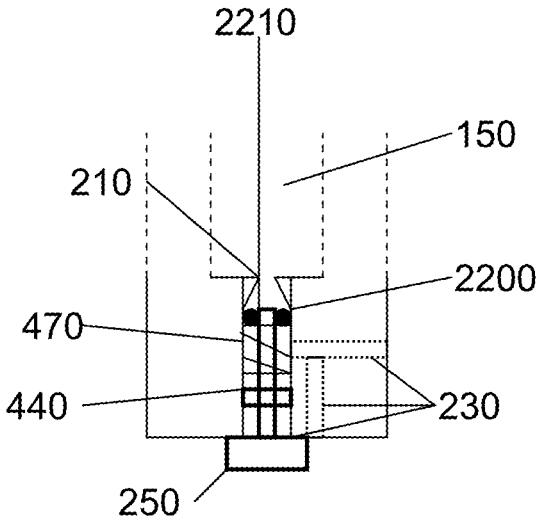
FIG. 27 illustrates the pressure relief mechanism of FIG. 26 in a combustion state.

To realize, combustion, the engagement mechanism is in a position, as illustrated in FIG. 27, which allows the pneumatic sealing device 2200 to be engaged with the plugging device 2210. In this state, the air within the chamber 150 cannot readily escape, thereby allowing the piston to increase the air pressure within the chamber 150, causing combustion of the tinder 140 (located at a tinder positioning area, tinder cavity, or tinder end of the piston 120).

As illustrated in FIGS. 26 and 27, the pressure relief mechanism enables combustion of the tinder, as well as, relief of the pressure to enable appropriate storage of the piston within the chamber 150.

Figure 28:
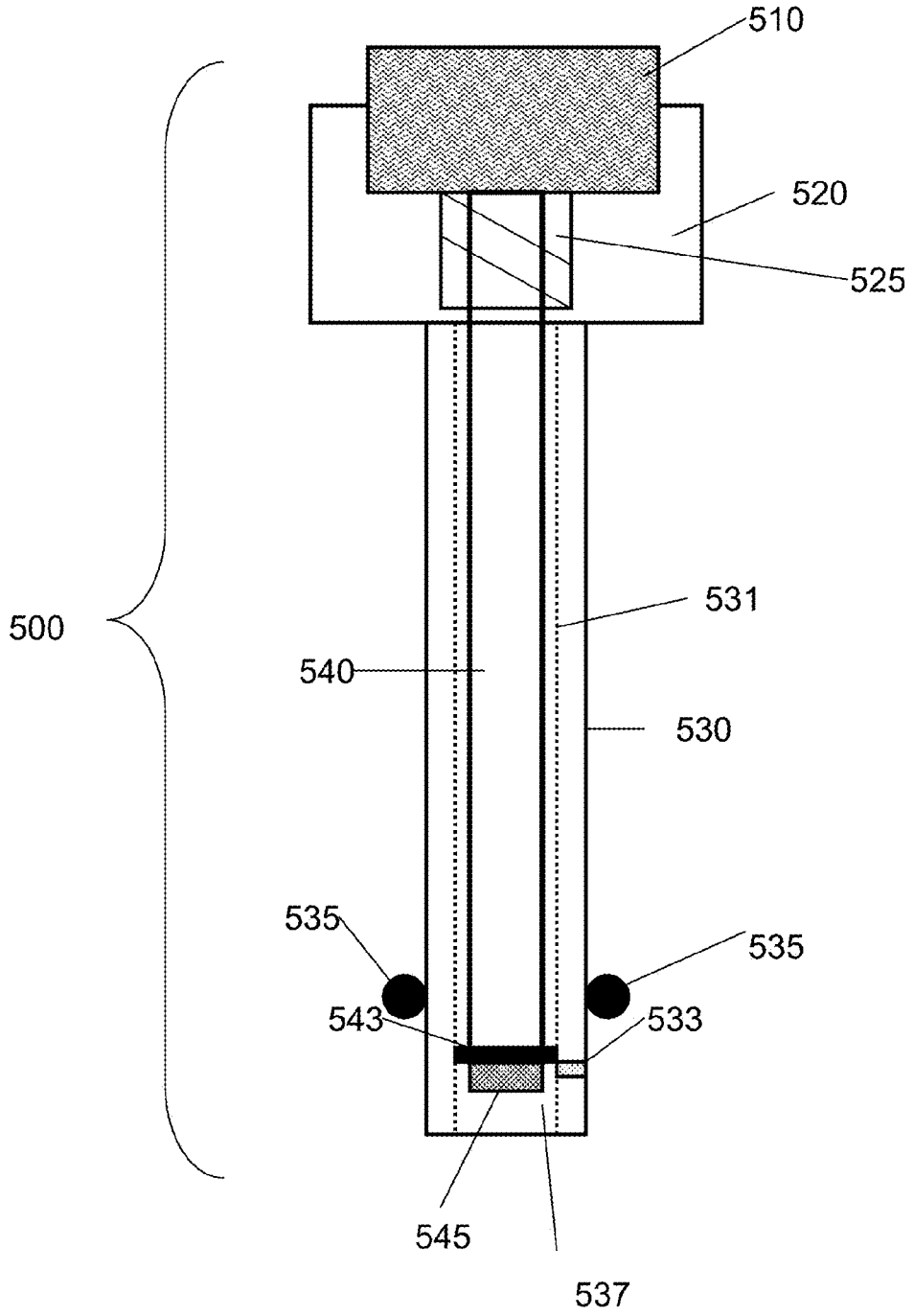
FIG. 28 illustrates an example of another pressure relief mechanism in a combustion state.

FIG. 28 illustrates another example of a pressure relief mechanism located within a plunger 500. The pressure relief mechanism includes an opening 533 located in the wall of outer shaft 530. The pressure relief mechanism also includes an inner rod 540 that is located in the inner chamber 531 of the outer shaft 530 and a pneumatic piston sealing device 535 located on a outer surface of the outer shaft 530. The pneumatic piston sealing device 535 engages the combustion chamber (not shown) of the housing (not shown).

An inner rod assembly includes the inner rod 540, a pneumatic sealing device 543, a tinder cavity 545, a bias/spring mechanism 525, and button 510. The bias/spring mechanism 525, and button 510 are located in a cap 520.

The opening 533 may be located between the location of the pneumatic piston sealing device 535 and the closed end of the chamber, as illustrated. The opening 533 enables the release of air from the chamber, when in a position as illustrated in FIG. 29.

The pressure relief mechanism also includes a pneumatic sealing device 543. The pneumatic sealing device 543 may be comprised of an o-ring, which engages with the inner chamber 531 of the outer shaft 530 to provide a proper pneumatic seal.

An engagement mechanism, comprising a locking device 440, a bias spring 470, and a handle 250, is used to engage or disengage the pneumatic sealing device 2200 with the plugging device 2210.

Figure 29:
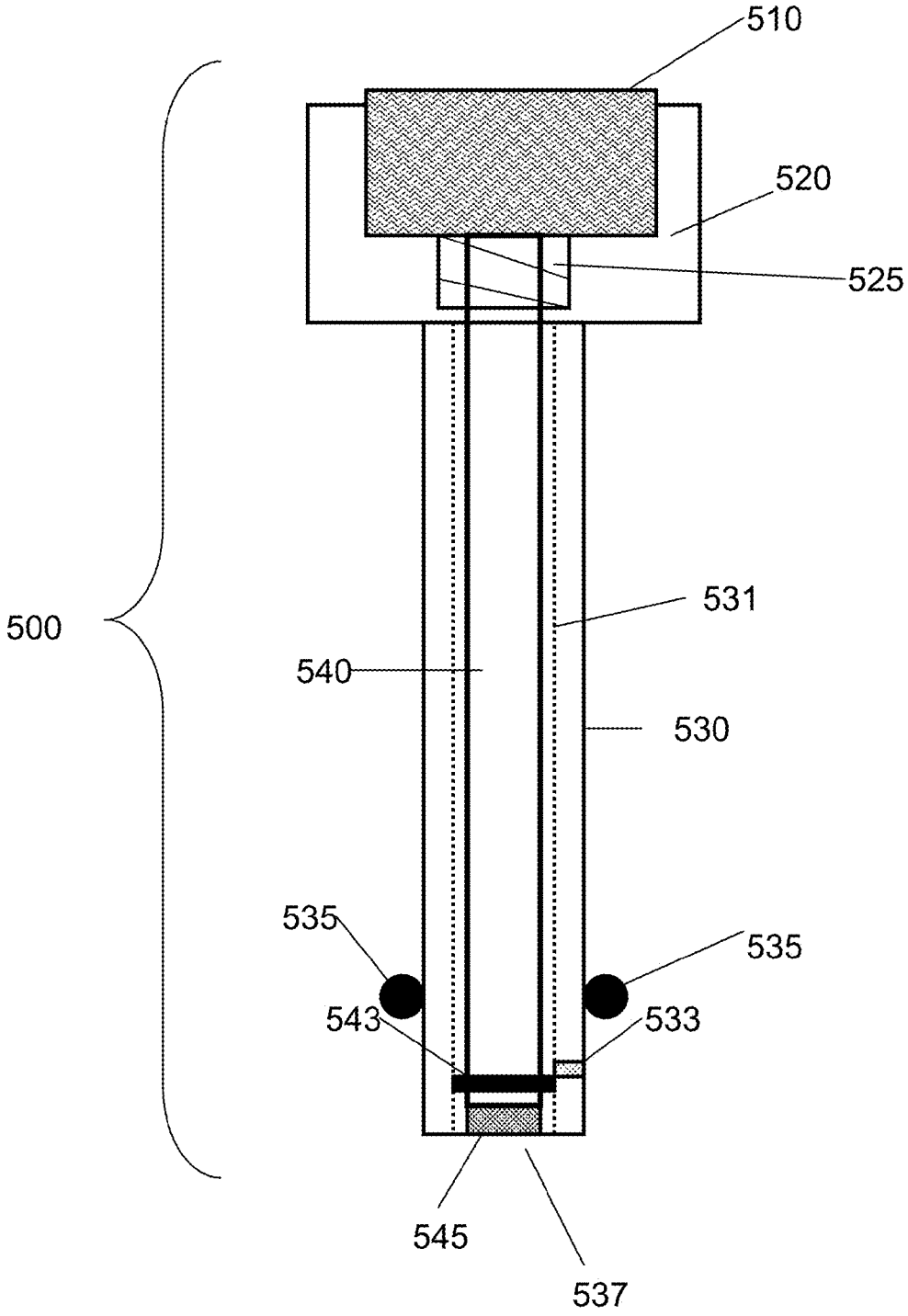
FIG. 29 illustrates the pressure relief mechanism of FIG. 26 in a pressure relief state.

As illustrated in FIG. 29, the inner rod 540 is moved forward so that the pneumatic sealing device 543 passes opening 533 in the wall of outer shaft 530 allowing venting therethrough. The inner rod 540 is moved forward by depressing button 510.

When the button 510 is released, the inner rod 540 returns to its original position, as a result of the bias/spring mechanism 525, and the pneumatic seal for combustion is re-established.

It is noted that the end of the inner rod 540 may form the bottom surface of the tinder cavity 545. When the button 510 is pushed (depressed), the inner rod 540 moves forward, ejecting the ignited tinder from the tinder cavity 545, through opening 537. This enables the ejecting of the ignited tinder without the need for a removal pick.

The bias/spring mechanism 525 may be used to bias the inner rod 540 to position the pneumatic sealing device 543 such that air cannot vent through opening 533. As illustrated in FIG. 28, the bias/spring mechanism 525 is used to bias the inner rod 540 to position the pneumatic sealing device 543 such that air cannot vent through opening 533.

The opening 533 is pneumatically connected to a relief channel (not shown) in button 520, which allows the air within the chamber to escape when pneumatic sealing device 543 is in a pressure relief position, as illustrated in FIG. 29. The relief channel may also be located so as to allow the air to escape at various locations.

When the inner rod 540 is in a position, which positions the pneumatic sealing device 543 such that air can vent through opening 533, thereby allowing the piston to be substantially placed within the chamber without causing combustion. This allows the piston to be stored substantially within the chamber.

To realize, combustion, the inner rod 540 is in a position, as illustrated in FIG. 28, which positions the pneumatic sealing device 543 such that air cannot vent through opening 533. In this state, the air within the chamber cannot readily escape, thereby allowing the plunger 500 to increase the air pressure within the chamber, causing combustion of the tinder in the tinder cavity 140.

As illustrated in FIGS. 28 and 29, the pressure relief mechanism enables combustion of the tinder, as well as, relief of the pressure to enable appropriate storage of the plunger/piston within the chamber.

In summary, the combustion device has a piston that is forcefully inserted within a chamber to develop sufficient pressure to heat tinder at or beyond a point of combustion. Only while the piston is being placed into a storage position is air permitted to escape from the chamber of the combustion device through either a valve embedded into the housing or piston. Additionally, as air is purged through the air channel during post ignition, the combustion process is accelerated.

Furthermore, combustion air can be provided from underneath the tinder fuel so as to provide an air source that moves through the tinder, rather than transversely.

Thus, a pressure relief mechanism has been provided to allow the piston to be fully inserted within the chamber for storage. Additionally, an opened valve within a piston, in combination with an air channel, provides airflow though a tinder material to sustain combustion.

A combustion device includes a housing having a chamber. The chamber has sidewalls, an open end, and a closed end. The combustion device further includes a piston to engage the housing, the piston including a pneumatic sealing device to engage the side walls of the chamber. The combustion device also includes a pressure relief mechanism including an opening located substantially near the closed end of the chamber.

A combustion device includes a housing having a chamber. The chamber has sidewalls, an open end, and a closed end. The combustion device further includes a piston to engage the housing, the piston including a pneumatic sealing device to engage the side walls of the chamber. The housing includes a pressure relief mechanism having an opening located substantially near the closed end of the chamber.

A combustion device includes a housing having a chamber. The chamber has sidewalls, an open end, and a closed end. The combustion device further includes a piston to engage the housing, the piston including a pneumatic sealing device to engage the side walls of the chamber.

The piston includes a tinder positioning area, the tinder positioning providing a location for tinder to be combusted, the tinder positioning area being located in close proximity with the closed end of the chamber to initiate combustion. The piston includes a pressure relief mechanism having an opening located substantially near the tinder positioning area of the piston.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A fire starting device, comprising:

a housing having a combustion chamber therein, said combustion chamber having sidewalls, said housing having an opening connected to said combustion chamber;

a piston having a first end and a second end;

a handle connected to said first end of said piston; and said second end of said piston being removable from said combustion chamber through said opening;

said second end of said piston entering said combustion chamber through said opening to increase pneumatic pressure within said combustion chamber;

said piston being removable from said combustion chamber and being removable from said housing;

a manually activated pneumatic pressure relief mechanism;

said manually activated pressure relief mechanism providing pneumatic pressure relief for said combustion chamber when said piston is positioned within said combustion chamber and said manually activated pressure relief mechanism is manually opened.

2. A starting device comprising:

a housing having a combustion chamber therein, said combustion chamber having sidewalls, said housing having an opening connected to said combustion chamber;

a piston having a first end and a second end; and a handle connected to said first end of said piston;

said second end of said piston being removable from said combustion chamber through said opening;

said second end of said piston entering said combustion chamber through said opening to increase pneumatic pressure within said combustion chamber;

said piston being removable from said combustion chamber and being removable from said housing;

said housing including a manually activated pneumatic pressure relief mechanism;

said manually activated pressure relief mechanism providing pneumatic pressure relief for said combustion chamber when said piston is positioned within said combustion chamber and said manually activated pressure relief mechanism is manually opened.

3. A fire starting device comprising:

a housing having a chamber therein, said combustion chamber forming a volume, said housing having an opening into said combustion chamber;

a piston having a first end and a second end; and a handle connected to said first end of said piston;

said second end of said piston being removable from said combustion chamber through said opening;

said second end of said piston entering said combustion chamber through said opening to increase pneumatic pressure within said combustion chamber;

said piston being removable from said combustion chamber and being removable from said housing;

said piston including a tinder positioning area, said tinder positioning area providing a location for tinder to be combusted, said tinder positioning area being located at said second end of said piston to enable combustion;

said handle including a manually activated pneumatic pressure relief mechanism;

said manually activated pressure relief mechanism providing pneumatic pressure relief for said combustion chamber when said piston is positioned within said combustion chamber and said manually activated pressure relief mechanism is manually opened.

4. The fire starting device as claimed in claim 1, wherein said manually activated pressure relief mechanism includes an air channel in said piston.

5. The fire starting device as claimed in claim 3, wherein said manually activated pressure relief mechanism includes an air channel in said piston.

6. The fire starting device as claimed in claim 1, wherein said manually activated pressure relief mechanism includes an air channel in said housing.

7. The fire starting device as claimed in claim 2, wherein said manually activated pressure relief mechanism includes an air channel in said housing.

8. The fire starting device as claimed in claim 1, wherein said piston includes a tinder positioning area, said tinder positioning area providing a location for tinder to be combusted, said tinder positioning area being located at said second end of said piston to enable combustion.

9. The fire starting device as claimed in claim 2, wherein said piston includes a tinder positioning area, said tinder positioning area providing a location for tinder to be combusted, said tinder positioning area being located at said second end of said piston to enable combustion.

10. The fire starting device as claimed in claim 7, wherein said piston includes an air channel between said handle and said tinder positioning area to provide airflow to said tinder positioning area.

11. The fire starting device as claimed in claim 9, wherein said piston includes an air channel between said handle and said tinder positioning area to provide airflow to said tinder positioning area.

12. The fire starting device as claimed in claim 3, wherein said piston includes an air channel between said handle and said tinder positioning area to provide airflow to said tinder positioning area.

13. The fire starting device as claimed in claim 7, wherein said tinder positioning area is a cavity in said second end of said piston.

14. The fire starting device as claimed in claim 9, wherein said tinder positioning area is a cavity in said second end of said removable piston.

15. The fire starting device as claimed in claim 3, wherein said tinder positioning area is a cavity in said second end of said piston.

16. The fire starting device as claimed in claim 1, wherein said manually activated pressure relief mechanism includes a biased closed pneumatic valve and a manual mechanism to open said biased closed pneumatic valve.

17. The fire starting device as claimed in claim 2, wherein said manually activated pressure relief mechanism includes a biased closed pneumatic valve and a manual mechanism to open said biased closed pneumatic valve.

18. The fire starting device as claimed in claim 3, wherein said manually activated pressure relief mechanism includes a biased closed pneumatic valve and a manual mechanism to open said biased closed pneumatic valve.

19. The fire starting device as claimed in claim 1, wherein said manually activated pressure relief mechanism includes a pneumatic slide valve having an open position and a closed position.

20. The fire starting device as claimed in claim 2, wherein said manually activated pressure relief mechanism includes a pneumatic slide valve having an open position and a closed position.

21. The fire starting device as claimed in claim 3, wherein said manually activated pressure relief mechanism includes a pneumatic slide valve having an open position and a closed position.

22. The fire starting device as claimed in claim 1, wherein said manually activated pressure relief mechanism includes a pneumatic rotary valve having a rotor aperture and a stator aperture;

said pneumatic rotary valve being in an open state when said rotor aperture is in alignment with said stator aperture.

23. The fire starting device as claimed in claim 2, wherein said manually activated pressure relief mechanism includes a pneumatic rotary valve having a rotor aperture and a stator aperture;

said pneumatic rotary valve being in an open state when said rotor aperture is in alignment with said stator aperture.

24. The fire starting device as claimed in claim 3, wherein said manually activated pressure relief mechanism includes a pneumatic rotary valve having a rotor aperture and a stator aperture;

said pneumatic rotary valve being in an open state when said rotor aperture is in alignment with said stator aperture.

25. The fire starting device as claimed in claim 3, wherein said manually activated pressure relief mechanism includes a pneumatic ball check valve;

said pneumatic ball check valve becoming closed in response to a rise in pressure in said chamber.

* * * * *